US008848936B2

(12) United States Patent
Kwatra et al.

(10) Patent No.: US 8,848,936 B2
(45) Date of Patent: Sep. 30, 2014

(54) SPEAKER DAMAGE PREVENTION IN ADAPTIVE NOISE-CANCELING PERSONAL AUDIO DEVICES

(75) Inventors: Nitin Kwatra, Austin, TX (US); Jon D. Hendrix, Wimberly, TX (US)

(73) Assignee: Cirrus Logic, Inc., Austin, TX (US)

( * ) Notice: Subject to any disclaimer, the term of this patent is extended or adjusted under 35 U.S.C. 154(b) by 594 days.

(21) Appl. No.: 13/249,687

(22) Filed: Sep. 30, 2011

(65) Prior Publication Data

US 2012/0308021 A1 Dec. 6, 2012

Related U.S. Application Data

(60) Provisional application No. 61/493,162, filed on Jun. 3, 2011.

(51) Int. Cl.
*G10K 11/16* (2006.01)
*G10K 11/178* (2006.01)

(52) U.S. Cl.
CPC .... *G10K 11/1788* (2013.01); *G10K 2210/3213* (2013.01); *G10K 2210/503* (2013.01); *G10K 2210/3037* (2013.01); *G10K 2210/3045* (2013.01); *G10K 2210/3017* (2013.01); *G10K 2210/3039* (2013.01)
USPC ..... 381/71.1

(58) Field of Classification Search
CPC ..... G10K 2210/3017; G10K 11/178; G10K 2210/1053; G10K 2210/1081; G10K 2210/30232; G10K 2210/3049; G10K 11/1788; G10K 2210/3037; G10K 2210/3039; H04R 1/1083; H04R 2420/07; H04R 5/033; H04R 1/1008; H04R 1/1016
USPC ..... 381/71.1–71.6, 71.11–71.14, 92, 381/0.56–59, 94.1–94.4; 379/406.06–406.08
See application file for complete search history.

(56) References Cited

U.S. PATENT DOCUMENTS 5,251,263 A * 10/1993 Andrea et al. ..... 381/71.6
5,337,365 A 8/1994 Hamabe et al.
5,425,105 A 6/1995 Lo et al.

(Continued)

FOREIGN PATENT DOCUMENTS

EP 2395500 A1 12/2011
GB 2401744 A 11/2004

(Continued)

OTHER PUBLICATIONS

Pfann, et al., "LMS Adaptive Filtering With Delta-Sigma Modulated Input Signals," IEEE Signal Processing Letters, Apr. 1998, pp. 95-97, vol. 5, No. 4, IEEE Press, Piscataway, NJ.

(Continued)

*Primary Examiner* — Lun-See Lao
(74) *Attorney, Agent, or Firm* — Mitch Harris, Atty at Law, LLC; Andrew M. Harris

(57) ABSTRACT

A personal audio device, such as a wireless telephone, includes noise canceling circuit that adaptively generates an anti-noise signal from a reference microphone signal and injects the anti-noise signal into the speaker or other transducer output to cause cancellation of ambient audio sounds. A processing circuit monitors a level of the anti-noise signal, determines that the anti-noise signal may cause damage to the transducer and adjusts the generation of the anti-noise signal such that damage to the transducer is prevented.

25 Claims, 5 Drawing Sheets

(56) References Cited

U.S. PATENT DOCUMENTS

| | | | | |
|---|---|---|---|---|
| 5,586,190 | A | 12/1996 | Trantow et al. | |
| 5,640,450 | A | 6/1997 | Watanabe | |
| 5,699,437 | A | 12/1997 | Finn | |
| 5,706,344 | A | 1/1998 | Finn | |
| 5,768,124 | A | 6/1998 | Stothers et al. | |
| 5,815,582 | A * | 9/1998 | Claybaugh et al. | 381/71.6 |
| 5,946,391 | A | 8/1999 | Dragwidge et al. | |
| 5,991,418 | A | 11/1999 | Kuo | |
| 6,041,126 | A * | 3/2000 | Terai et al. | 381/71.6 |
| 6,118,878 | A | 9/2000 | Jones | |
| 6,219,427 | B1 | 4/2001 | Kates et al. | |
| 6,418,228 | B1 | 7/2002 | Terai et al. | |
| 6,434,246 | B1 | 8/2002 | Kates et al. | |
| 6,434,247 | B1 | 8/2002 | Kates et al. | |
| 6,768,795 | B2 | 7/2004 | Feltstrom et al. | |
| 6,850,617 | B1 | 2/2005 | Weigand | |
| 7,103,188 | B1 | 9/2006 | Jones | |
| 7,181,030 | B2 | 2/2007 | Rasmussen et al. | |
| 7,330,739 | B2 | 2/2008 | Somayajula | |
| 7,365,669 | B1 | 4/2008 | Melanson | |
| 7,742,790 | B2 | 6/2010 | Konchitsky et al. | |
| 8,019,050 | B2 | 9/2011 | Mactavish et al. | |
| 8,249,262 | B2 | 8/2012 | Chua et al. | |
| 8,290,537 | B2 | 10/2012 | Lee et al. | |
| 8,379,884 | B2 | 2/2013 | Horibe et al. | |
| 8,385,559 | B2 * | 2/2013 | Theverapperuma et al. | 381/71.6 |
| 2001/0053228 | A1 | 12/2001 | Jones | |
| 2002/0003887 | A1 | 1/2002 | Zhang et al. | |
| 2004/0165736 | A1 | 8/2004 | Hetherington et al. | |
| 2004/0167777 | A1 | 8/2004 | Hetherington et al. | |
| 2004/0264706 | A1 | 12/2004 | Ray et al. | |
| 2005/0117754 | A1 | 6/2005 | Sakawaki | |
| 2006/0153400 | A1 | 7/2006 | Fujita et al. | |
| 2007/0030989 | A1 | 2/2007 | Kates | |
| 2007/0038441 | A1 | 2/2007 | Inoue et al. | |
| 2007/0053524 | A1 | 3/2007 | Haulick et al. | |
| 2007/0076896 | A1 | 4/2007 | Hosaka et al. | |
| 2007/0154031 | A1 | 7/2007 | Avendano et al. | |
| 2007/0258597 | A1 | 11/2007 | Rasmussen et al. | |
| 2007/0297620 | A1 | 12/2007 | Choy | |
| 2008/0019548 | A1 | 1/2008 | Avendano | |
| 2008/0181422 | A1 | 7/2008 | Christoph | |
| 2008/0226098 | A1 | 9/2008 | Haulick et al. | |
| 2009/0012783 | A1 | 1/2009 | Klein | |
| 2009/0034748 | A1 | 2/2009 | Sibbald | |
| 2009/0041260 | A1 | 2/2009 | Jorgensen et al. | |
| 2009/0046867 | A1 | 2/2009 | Clemow | |
| 2009/0196429 | A1 | 8/2009 | Ramakrishnan et al. | |
| 2009/0220107 | A1 | 9/2009 | Every et al. | |
| 2009/0238369 | A1 | 9/2009 | Ramakrishnan et al. | |
| 2009/0245529 | A1 | 10/2009 | Asada et al. | |
| 2009/0290718 | A1 | 11/2009 | Kahn et al. | |
| 2009/0296965 | A1 | 12/2009 | Kojima | |
| 2009/0304200 | A1 | 12/2009 | Kim et al. | |
| 2010/0014683 | A1 | 1/2010 | Maeda et al. | |
| 2010/0014685 | A1 | 1/2010 | Wurm | |
| 2010/0061564 | A1 | 3/2010 | Clemow et al. | |
| 2010/0069114 | A1 | 3/2010 | Lee et al. | |
| 2010/0082339 | A1 | 4/2010 | Konchitsky et al. | |
| 2010/0098263 | A1 | 4/2010 | Pan et al. | |
| 2010/0124336 | A1 | 5/2010 | Shridhar et al. | |
| 2010/0166203 | A1 | 7/2010 | Peissig et al. | |
| 2010/0195838 | A1 | 8/2010 | Bright | |
| 2010/0195844 | A1 | 8/2010 | Christoph et al. | |
| 2010/0272283 | A1 | 10/2010 | Carreras et al. | |
| 2010/0274564 | A1 | 10/2010 | Bakalos et al. | |
| 2010/0296666 | A1 | 11/2010 | Lin | |
| 2010/0296668 | A1 | 11/2010 | Lee et al. | |
| 2010/0310086 | A1 | 12/2010 | Magrath et al. | |
| 2010/0322430 | A1 | 12/2010 | Isberg | |
| 2011/0007907 | A1 | 1/2011 | Park et al. | |
| 2011/0106533 | A1 | 5/2011 | Yu | |
| 2011/0142247 | A1 | 6/2011 | Fellers et al. | |
| 2011/0144984 | A1 | 6/2011 | Konchitsky | |
| 2011/0158419 | A1 | 6/2011 | Theverapperuma et al. | |
| 2011/0222698 | A1 | 9/2011 | Asao et al. | |
| 2011/0249826 | A1 | 10/2011 | Van Leest | |
| 2011/0288860 | A1 | 11/2011 | Schevciw et al. | |
| 2011/0293103 | A1 | 12/2011 | Park et al. | |
| 2011/0299695 | A1 | 12/2011 | Nicholson | |
| 2012/0140943 | A1 | 6/2012 | Hendrix et al. | |
| 2012/0207317 | A1 | 8/2012 | Abdollahzadeh Milani et al. | |
| 2012/0308024 | A1 | 12/2012 | Alderson et al. | |
| 2012/0308025 | A1 | 12/2012 | Hendrix et al. | |
| 2012/0308026 | A1 | 12/2012 | Kamath et al. | |
| 2012/0308027 | A1 | 12/2012 | Kwatra | |
| 2012/0308028 | A1 | 12/2012 | Kwatra et al. | |
| 2012/0310640 | A1 | 12/2012 | Kwatra et al. | |
| 2013/0272539 | A1 | 10/2013 | Kim et al. | |
| 2013/0287218 | A1 | 10/2013 | Alderson et al. | |
| 2013/0287219 | A1 | 10/2013 | Hendrix et al. | |
| 2013/0301842 | A1 | 11/2013 | Hendrix et al. | |
| 2013/0301846 | A1 | 11/2013 | Alderson et al. | |
| 2013/0301847 | A1 | 11/2013 | Alderson et al. | |
| 2013/0301848 | A1 | 11/2013 | Zhou et al. | |
| 2013/0301849 | A1 | 11/2013 | Alderson et al. | |
| 2013/0343556 | A1 | 12/2013 | Bright | |

FOREIGN PATENT DOCUMENTS

| | | | |
|---|---|---|---|
| GB | 2455821 | A | 6/2009 |
| GB | 2455824 | A | 6/2009 |
| GB | 2455828 | A | 6/2009 |
| JP | H06-186985 | A | 7/1994 |
| WO | WO 2007007916 | A1 | 1/2007 |
| WO | WO 2007113487 | A1 | 11/2007 |
| WO | WO 2010117714 | A1 | 10/2010 |
| WO | WO 2012134874 | A1 | 10/2012 |

OTHER PUBLICATIONS

Kuo, et al., "Active Noise Control: A Tutorial Review," Proceedings of the IEEE, Jun. 1999, pp. 943-973, vol. 87, No. 6, IEEE Press, Piscataway, NJ.

Kates, James M., "Principles of Digital Dynamic Range Compression," Trends in Amplification, Spring 2005, pp. 45-76, vol. 9, No. 2, Sage Publications.

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.

U.S. Appl. No. 14/029,159, filed Sep. 17, 2013, Li, et al.

U.S. Appl. No. 14/062,951, filed Oct. 25, 2013, Zhou, et al.

Abdollahzadeh Milani, et al., "On Maximum Achievable Noise Reduction in ANC Systems",2010 IEEE International Conference of Acoustics Speech and Signal Processing, Mar. 14-19, 2010, pp. 349-352, Dallas, TX, US.

U.S. Appl. No. 14/228,322, filed Mar. 28, 2014, Alderson, et al.

U.S. Appl. No. 13/762,504, filed Feb. 8, 2013, Abdollahzadeh Milani, et al.

U.S. Appl. No. 13/721,832, filed Dec. 20, 2012, Lu, et al.

U.S. Appl. No. 13/724,656, filed Dec. 21, 2012, Lu, et al.

U.S. Appl. No. 14/252,235, filed Apr. 14, 2014, Lu, et al.

U.S. Appl. No. 13/968,013, filed Aug. 15, 2013, Abdollahzadeh Milani, et al.

U.S. Appl. No. 13/924,935, filed Jun. 24, 2013, Hellman.

U.S. Appl. No. 13/896,526, filed May 17, 2013, Naderi.

U.S. Appl. No. 14/101,955, filed Dec. 10, 2013, Alderson.

U.S. Appl. No. 14/101,777, filed Dec. 10, 2013, Alderson, et al.

Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.

Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.

Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.

(56) References Cited

OTHER PUBLICATIONS

Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Kuo, et al., "Residual noise shaping technique for active noise control systems", J. Acoust. Soc. Am. 95 (3), Mar. 1994, pp. 1665-1668.
Lopez-Caudana, Edgar Omar, "Active Noise Cancellation: The Unwanted Signal and the Hybrid Solution", Adaptive Filtering Applications, Dr. Lino Garcia (Ed.), Jul. 2011, pp. 49-84, ISBN: 978-953-307-306-4, InTech.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Hurst, et al., "An improved double sampling scheme for switched-capacitor delta-sigma modulators", 1992 IEEE Int. Symp. On Circuits and Systems, May 10-13, 1992, vol. 3, pp. 1179-1182, San Diego, CA.
U.S. Appl. No. 13/686,353, filed Nov. 27, 2012, Hendrix, et al.
U.S. Appl. No. 13/795,160, filed Mar. 12, 2013, Hendrix, et al.
U.S. Appl. No. 13/692,367, filed Dec. 3, 2012, Alderson, et al.
U.S. Appl. No. 13/722,119, filed Dec. 20, 2012, Hendrix, et al.
U.S. Appl. No. 13/727,718, filed Dec. 27, 2012, Alderson, et al.
U.S. Appl. No. 13/784,018, filed Mar. 4, 2013, Alderson, et al.
U.S. Appl. No. 13/787,906, filed Mar. 7, 2013, Alderson, et al.
U.S. Appl. No. 13/729,141, filed Dec. 28, 2012, Zhou, et al.
U.S. Appl. No. 13/794,931, filed Mar. 12, 2013, Lu, et al.
U.S. Appl. No. 13/794,979, filed Mar. 12, 2013, Alderson, et al.
Toochinda, et al. "A Single-Input Two-Output Feedback Formulation for ANC Problems," Proceedings of the 2001 American Control Conference, Jun. 2001, pp. 923-928, vol. 2, Arlington, VA.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
U.S. Appl. No. 14/197,814, filed Mar. 5, 2014, Kaller, et al.
U.S. Appl. No. 14/210,537, filed Mar. 14, 2014, Abdollahzadeh Milani, et al.
U.S. Appl. No. 14/210,589, filed Mar. 14, 2014, Abdollahzadeh Milani, et al.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-Shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem With Mobile Remote Presence Systems", Symposium on User Interface Software and Technology, Oct. 16-19, 2011, 10 pages (pp. 1-10 in pdf), Santa Barbara, CA, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
U.S. Appl. No. 13/968,007, filed Aug. 15, 2013, Hendrix, et al.

* cited by examiner

SPEAKER DAMAGE PREVENTION IN ADAPTIVE NOISE-CANCELING PERSONAL AUDIO DEVICES

This U.S. patent application Claims priority under 35 U.S.C. §119(e) to U.S. Provisional Patent Application Ser. No. 61/493,162 filed on Jun. 3, 2011.

BACKGROUND OF THE INVENTION

1. Field of the Invention

The present invention relates generally to personal audio devices such as wireless telephones that include noise cancellation, and more specifically, to a personal audio device in which damage to the output transducer is prevented while still providing adaptive noise canceling.

2. Background of the Invention

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

Since the acoustic environment around personal audio devices such as wireless telephones can change dramatically, depending on the sources of noise that are present and the position of the device itself, it is desirable to adapt the noise canceling to take into account such environmental changes. However, adaptive noise canceling circuits can be complex, consume additional power and can generate undesirable results under certain circumstances.

Therefore, it would be desirable to provide a personal audio device, including a wireless telephone, that provides noise cancellation in a variable acoustic environment.

SUMMARY OF THE INVENTION

The above stated objective of providing a personal audio device providing noise cancellation in a variable acoustic environment, is accomplished in a personal audio device, a method of operation, and an integrated circuit.

The personal audio device includes a housing, with a transducer mounted on the housing for reproducing an audio signal that includes both source audio for playback to a listener and an anti-noise signal for countering the effects of ambient audio sounds in an acoustic output of the transducer. A reference microphone is mounted on the housing to provide a reference microphone signal indicative of the ambient audio sounds. The personal audio device further includes an adaptive noise cancelling (ANC) processing circuit within the housing for adaptively generating the anti-noise signal from the reference microphone signal such that the anti-noise signal causes substantial cancellation of the ambient audio sounds. The ANC processing circuit monitors a level of the anti-noise signal, determines that the anti-noise signal may cause damage to the transducer and adjusts the generation of the anti-noise signal such that damage to the transducer is prevented. The integrated circuit includes a processing circuit that performs such monitoring and adjusting, and the method is a method of operation of the integrated circuit.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

The present invention encompasses noise canceling techniques and circuits that can be implemented in a personal audio device, such as a wireless telephone. The personal audio device includes an adaptive noise canceling (ANC) circuit that measures the ambient acoustic environment and generates an adaptive signal that is injected in the speaker (or other transducer) output to cancel ambient acoustic events. The ANC circuit monitors a level of the anti-noise signal to determine if damage to the speaker or other transducer is imminent and adjusts the anti-noise signal if speaker damage might occur.

Figure 1:
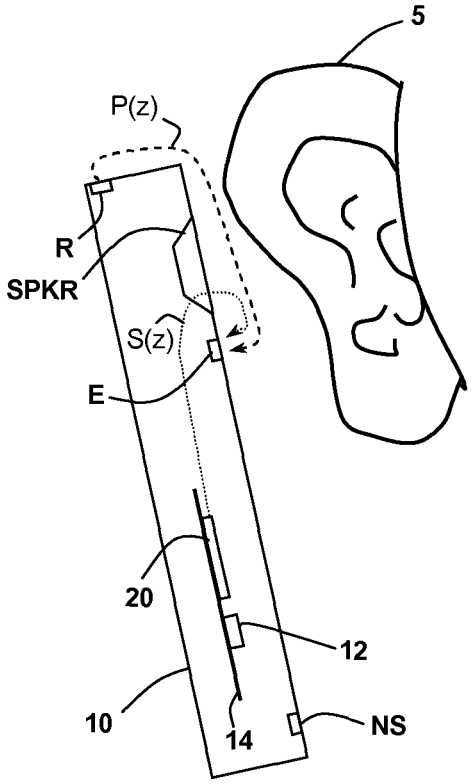
FIG. 1 is an illustration of a wireless telephone 10 in accordance with an embodiment of the present invention.

Referring now to FIG. 1, a wireless telephone 10 is illustrated in accordance with an embodiment of the present invention is shown in proximity to a human ear 5. Illustrated wireless telephone 10 is an example of a device in which techniques in accordance with embodiments of the invention may be employed, but it is understood that not all of the elements or configurations embodied in illustrated wireless telephone 10, or in the circuits depicted in subsequent illustrations, are required in order to practice the invention recited in the Claims. Wireless telephone 10 includes a transducer such as speaker SPKR that reproduces distant speech received by wireless telephone 10, along with other local audio sources such as ringtones, stored audio program material, injection of near-end speech (i.e., the speech of the user of wireless telephone 10) to provide a balanced conversational perception, and other audio that requires reproduction by wireless telephone 10, such as sources from web-pages or other network communications received by wireless telephone 10 and audio indications such as battery low and other system event notifications. A near-speech microphone NS is provided to capture near-end speech, which is transmitted from wireless telephone 10 to the other conversation participant(s).

Wireless telephone 10 includes adaptive noise canceling (ANC) circuits and features that inject an anti-noise signal into speaker SPKR to improve intelligibility of the distant speech and other audio reproduced by speaker SPKR. A reference microphone R is provided for measuring the ambient acoustic environment, and is positioned away from the typical position of a user's mouth, so that the near-end speech is minimized in the signal produced by reference microphone R. A third microphone, error microphone E is provided in order to further improve the ANC operation by providing a measure of the ambient audio combined with the audio reproduced by speaker SPKR close to ear 5, when wireless telephone 10 is in close proximity to ear 5. Exemplary circuits 14 within wireless telephone 10 include an audio CODEC integrated circuit 20 that receives the signals from reference microphone R, near speech microphone NS and error microphone E and interfaces with other integrated circuits such as a radio frequency (RF) integrated circuit 12 containing the wireless telephone transceiver. In other embodiments of the invention, the circuits and techniques disclosed herein may be incorporated in a single integrated circuit that contains control circuits and other functionality for implementing the entirety of the personal audio device, such as an MP3 player-on-a-chip integrated circuit.

In general, the ANC techniques of the present invention measure ambient acoustic events (as opposed to the output of speaker SPKR and/or the near-end speech) impinging on reference microphone R, and by also measuring the same ambient acoustic events impinging on error microphone E, the ANC processing circuits of illustrated wireless telephone 10 adapt an anti-noise signal generated from the output of reference microphone R to have a characteristic that minimizes the amplitude of the ambient acoustic events at error microphone E. Since acoustic path P(z) extends from reference microphone R to error microphone E, the ANC circuits are essentially estimating acoustic path P(z) combined with removing effects of an electro-acoustic path S(z). Electro-acoustic path S(z) represents the response of the audio output circuits of CODEC IC 20 and the acoustic/electric transfer function of speaker SPKR, including the coupling between speaker SPKR and error microphone E in the particular acoustic environment, which is affected by the proximity and structure of ear 5 and other physical objects and human head structures that may be in proximity to wireless telephone 10, when wireless telephone is not firmly pressed to ear 5. While the illustrated wireless telephone 10 includes a two microphone ANC system with a third near speech microphone NS, some aspects of the present invention may be practiced in a system that does not include separate error and reference microphones, or a wireless telephone that uses near speech microphone NS to perform the function of the reference microphone R. Also, in personal audio devices designed only for audio playback, near speech microphone NS will generally not be included, and the near-speech signal paths in the circuits described in further detail below can be omitted, without changing the scope of the invention.

Figure 2:
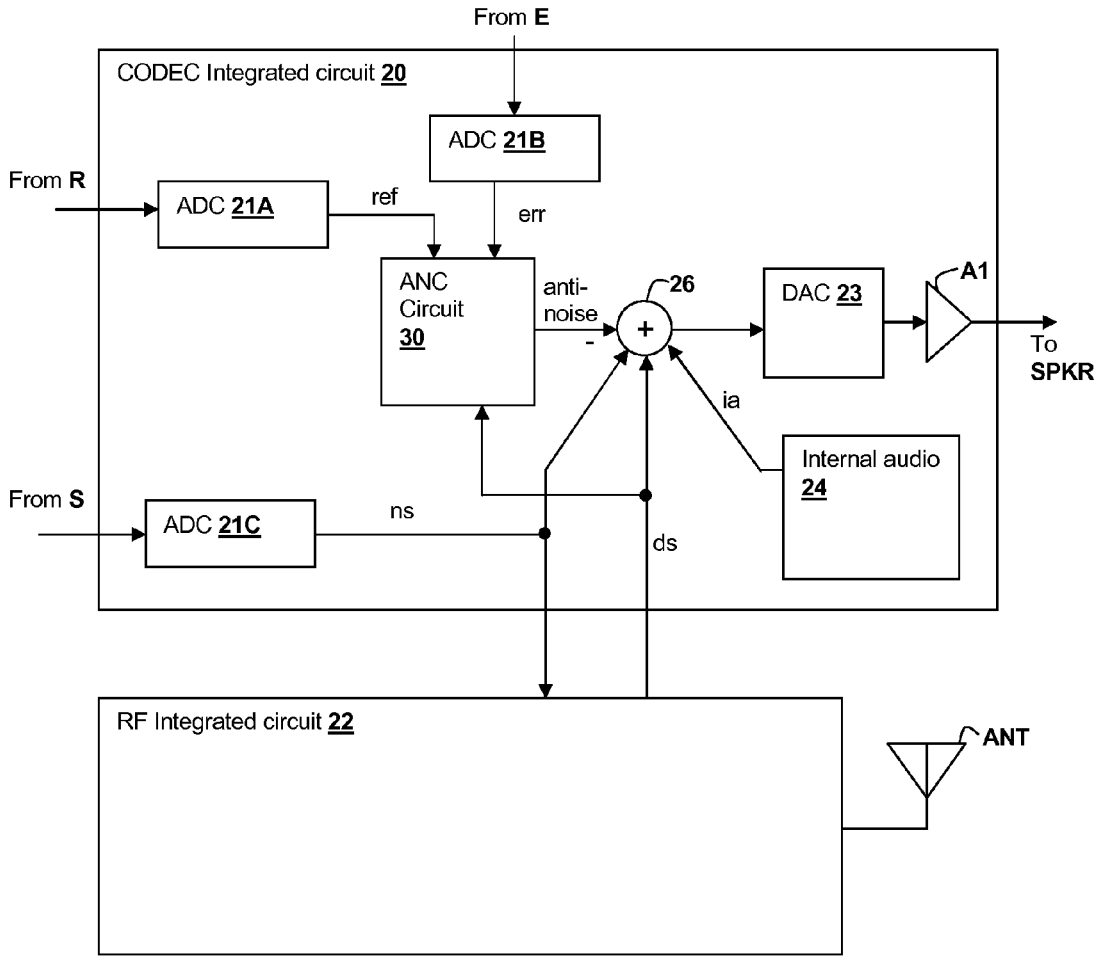
FIG. 2 is a block diagram of circuits within wireless telephone 10 in accordance with an embodiment of the present invention.

Referring now to FIG. 2, circuits within wireless telephone 10 are shown in a block diagram. CODEC integrated circuit 20 includes an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC integrated circuit 20 generates an output for driving speaker SPKR from an amplifier A1, which amplifies the output of a digital-to-analog converter (DAC) 23 that receives the output of a combiner 26. Combiner 26 combines audio signals from internal audio sources 24 and the anti-noise signal generated by ANC circuit 30, which by convention has the same polarity as the noise in reference microphone signal ref and is therefore subtracted by combiner 26. Combiner 26 also injects a portion of near speech signal ns so that the user of wireless telephone 10 hears their own voice in proper relation to downlink speech ds, which is received from RF integrated circuit 22 and is also combined by combiner 26. Near speech signal is also provided to RF integrated circuit 22 and is transmitted as uplink speech to a mobile telephone service provider via antenna ANT.

Figure 3:
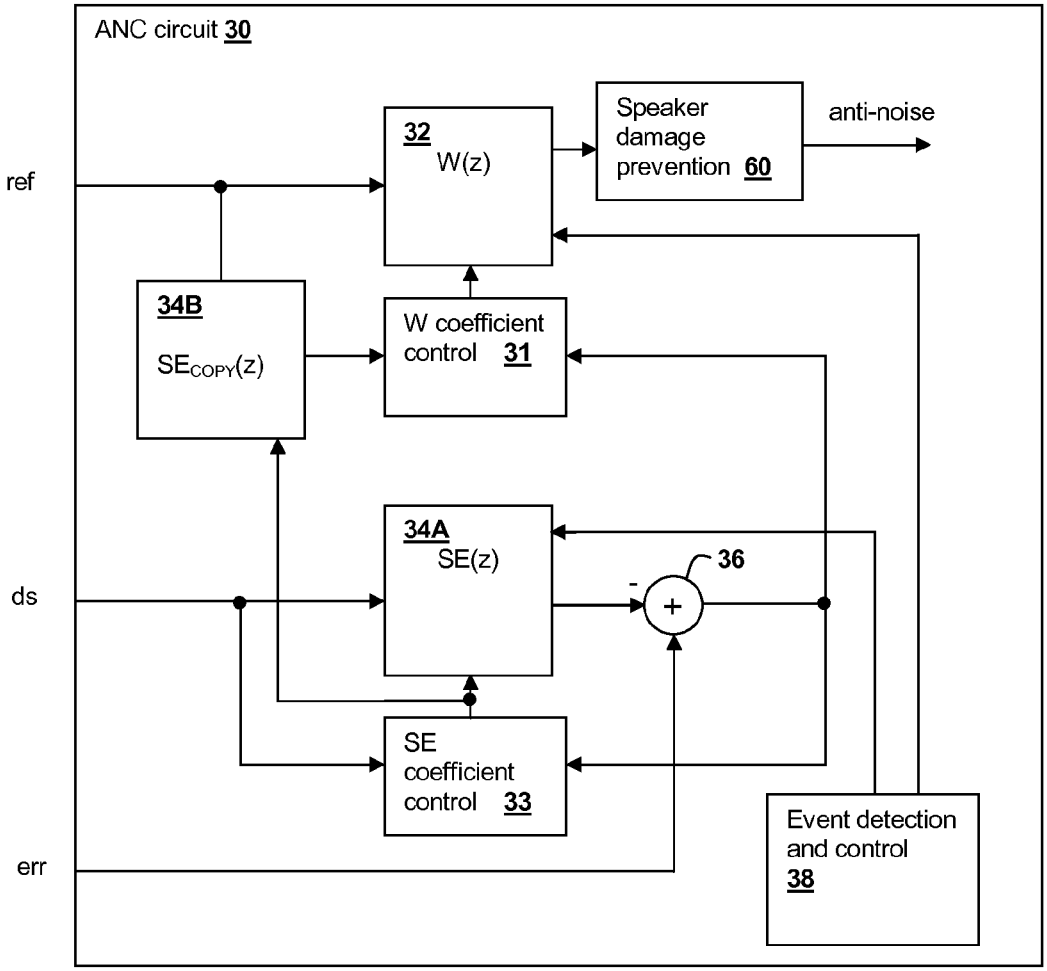
FIG. 3 is a block diagram depicting signal processing circuits and functional blocks within ANC circuit 30 of CODEC integrated circuit 20 of FIG. 2 in accordance with an embodiment of the present invention.

Referring now to FIG. 3, details of ANC circuit 30 are shown in accordance with an embodiment of the present invention. Adaptive filter 32 receives reference microphone signal ref and under ideal circumstances, adapts its transfer function W(z) to be P(z)/S(z) to generate the anti-noise signal. The coefficients of adaptive filter 32 are controlled by a coefficient control block 31 that uses a correlation of two signals to determine the response of adaptive filter 32, which generally minimizes the error, in a least-means squares sense, between those components of reference microphone signal ref and error microphone signal err. The signals compared by W coefficient control block 31 are the reference microphone signal ref as shaped by a copy of an estimate of path S(z) provided by filter 34B and another signal that includes error microphone signal err. By transforming reference microphone signal ref with a copy of the estimate of the response of path S(z), $SE_{COPY}(z)$, and minimizing the difference between the resultant signal and error microphone signal err, adaptive filter 32 adapts to the desired response of P(z)/S(z) by adapting to remove the effect of applying response $SE_{COPY}(z)$ from reference microphone signal ref. In addition to error microphone signal err the signal compared to the output of filter 34B by W coefficient control block 31 includes an inverted amount of downlink audio signal ds that has been processed by filter response SE(z), of which filter response $SE_{COPY}(z)$ is a copy. By injecting an inverted amount of downlink audio signal ds adaptive filter 32 is prevented from adapting to the relatively large amount of downlink audio present in error microphone signal err and by transforming that inverted copy of downlink audio signal ds with the estimate of the response of path S(z), the downlink audio that is removed from error microphone signal err before comparison should match the expected version of downlink audio signal ds reproduced at error microphone signal err, since the electrical and acoustical path of S(z) is the path taken by downlink audio signal ds to arrive at error microphone E.

To implement the above, adaptive filter 34A has coefficients controlled by SE coefficient control block 33, which compares downlink audio signal ds and error microphone signal err after removal of the above-described filtered downlink audio signal ds, that has been filtered by adaptive filter 34A to represent the expected downlink audio delivered to error microphone E, and which is removed from the output of adaptive filter 34A by a combiner 36. SE coefficient control block 33 correlates the actual downlink speech signal ds with the components of downlink audio signal ds that are present in error microphone signal err. Adaptive filter 34A is thereby adapted to generate a signal from downlink audio signal ds, that when subtracted from error microphone signal err, contains the content of error microphone signal err that is not due to downlink audio signal ds. Event detection and control logic 38 perform various actions in response to various events in conformity with various embodiments of the invention, as will be disclosed in further detail below.

Since adaptive filter 32 can have a wide range of gain at different frequencies that depends on the environment to which W coefficient control 31 adapts the response of adaptive filter 32, the anti-noise signal produced by ANC circuit 30 could assume high amplitudes that could cause damage to speaker SPKR, particularly at low frequencies at which speaker SPKR has poor acoustical response. The high amplitudes can happen because W coefficient control 31 will generally attempt to cancel any low frequency ambient acoustic events by raising the gain of adaptive filter 32 in those frequency bands, irrespective of the frequency response of speaker SPKR. Further, low frequency signal components can stimulate resonances that are more damaging to speaker SPKR than higher frequency components. Therefore, a speaker damage prevention circuit 60 is included within ANC circuit 20 to process the anti-noise signal in order to prevent damage to speaker SPKR.

Figure 4:
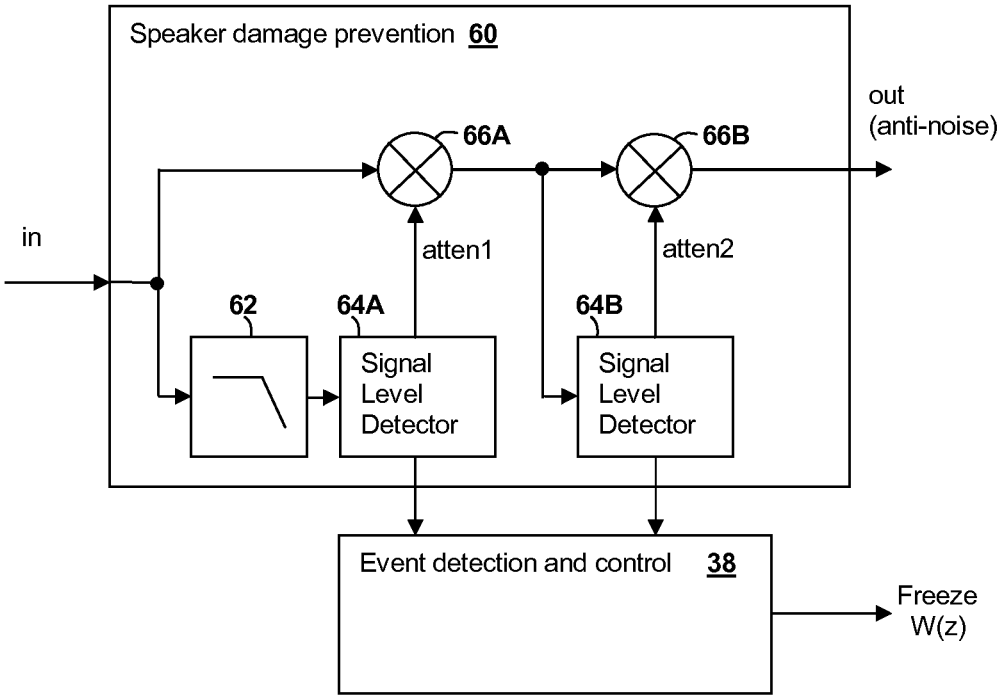
FIG. 4 is a block diagram depicting details of speaker damage prevention circuit 60 of FIG. 3 in accordance with an embodiment of the present invention.

Referring now to FIG. 4, details of speaker damage prevention circuit 60 are shown in accordance with an embodiment of the present invention. An input signal in is received from the output of adaptive filter 32 and a multiplier 66A applies a variable attenuation value atten1 that is determined by a signal level detector 64A that detects the level of a filtered version of input signal in that is generated by a low-pass filter 62. Low-pass filter 62 removes higher frequency components from input signal in, e.g. frequency components above 500 Hz and therefore attenuation value atten1 is determined almost entirely by energy in input signal in that lies in the frequency range below 500 Hz. Multiplier 66A provides a gain control block that adjusts the level of input signal in without filtering input signal in, i.e. without changing the spectrum of input signal in, only the overall gain. Another multiplier 66B provides a second gain control cell that adjusts the level of the output of first multiplier 66A according to an attenuation value atten2 that is determined from an unfiltered output of first multiplier 66A by a second signal level detector 64B. Signal level detectors 64A and 64B in the depicted embodiment are threshold detectors, i.e., attenuation values atten 1 and atten 2 are applied once the corresponding signal levels reaching the inputs of signal level detectors 64A and 64B exceed a predetermined threshold. Further, the change of the attenuation values atten 1 and atten 2 with signal levels are such that an infinite compression ratio is applied, i.e., attenuation values atten 1 and atten 2 vary to ensure that the corresponding signal levels do not exceed the corresponding thresholds. Therefore, low-pass filter 62, signal level detector 64A and multiplier 66A form a first soft limiter, and signal level detector 64B and multiplier 66B form a second soft limiter. In other embodiments of the invention, the compression ratio may be less than infinite, and threshold detection may be omitted, so that a pure compression is applied rather than limiting.

Additionally, when either or both of the first and second limiters are active, and since the adaptive filter control equations no longer apply, event detection and control block 38 acts to freeze the adaptation of W(z), i.e., W coefficient control block 31 is signaled to stop changing the values of the coefficients of adaptive filter 32 until both signal level detectors 64A and 64B indicate that limiting is no longer being applied to the anti-noise signal.

Figure 5:
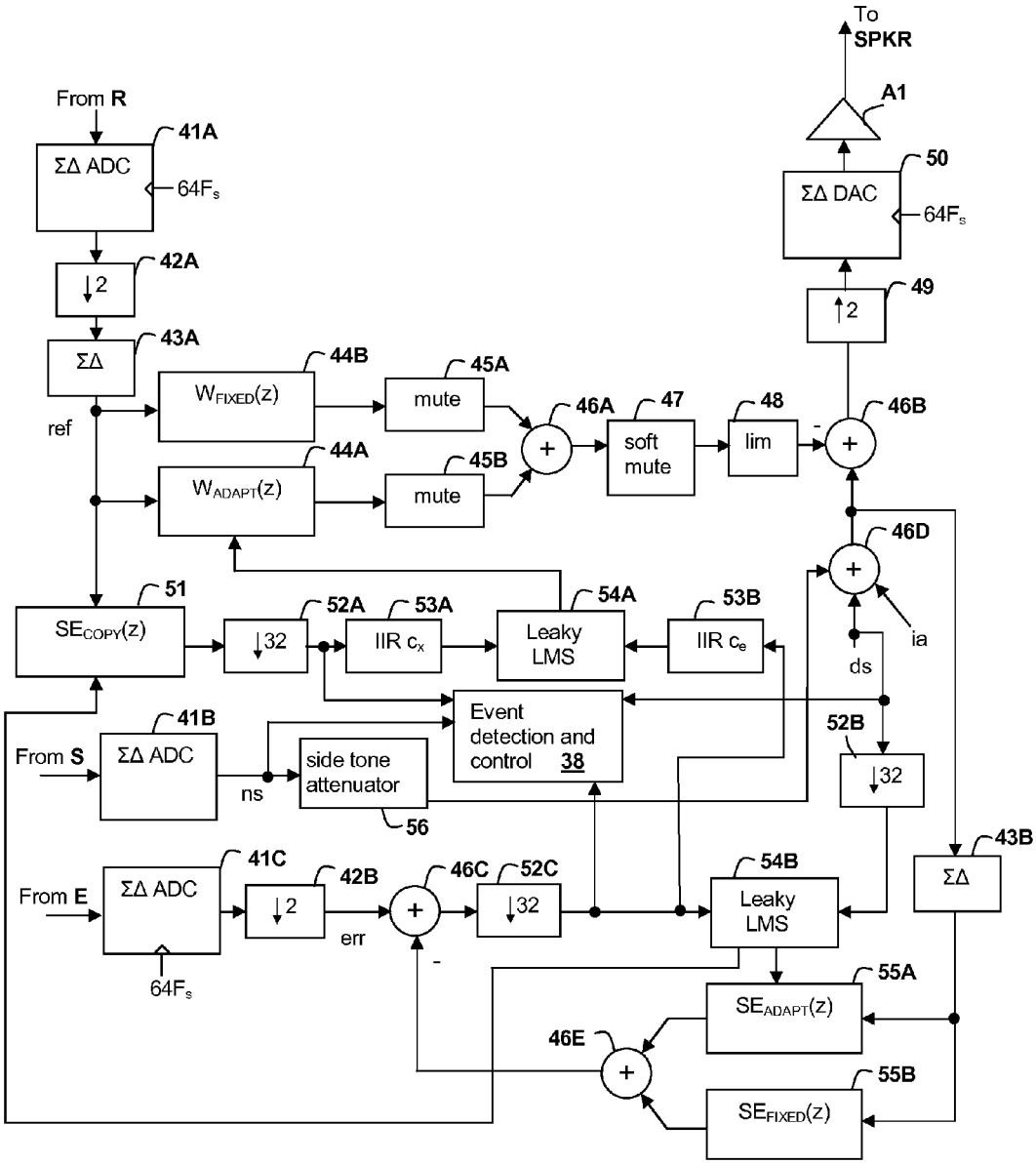
FIG. 5 is a block diagram depicting signal processing circuits and functional blocks within an integrated circuit in accordance with an embodiment of the present invention.

Referring now to FIG. 5, a block diagram of an ANC system in accordance with an embodiment of the invention is shown, as may be implemented within CODEC integrated circuit 20. Reference microphone signal ref is generated by a delta-sigma ADC 41A that operates at 64 times oversampling and the output of which is decimated by a factor of two by a decimator 42A to yield a 32 times oversampled signal. A delta-sigma shaper 43A spreads the energy of images outside of bands in which a resultant response of a parallel pair of adaptive filter stages 44A and 44B will have significant response. Filter stage 44B has a fixed response $W_{FIXED}(z)$ that is generally predetermined to provide a starting point at the estimate of P(z)/S(z) for the particular design of wireless telephone 10 for a typical user. An adaptive portion $W_{ADAPT}(z)$ of the response of the estimate of P(z)/S(z) is provided by adaptive filter stage 44A, which is controlled by a leaky least-means-squared (LMS) coefficient controller 54A. Leaky LMS coefficient controller 54A is leaky in that the response normalizes to flat or otherwise predetermined response over time when no error input is provided to cause leaky LMS coefficient controller 54A to adapt. Providing a leaky controller prevents long-term instabilities that might arise under certain environmental conditions, and in general makes the system more robust against particular sensitivities of the ANC response.

As in the example of FIG. 3, reference microphone signal ref is filtered by a filter response $SE_{COPY}(z)$ that is a copy of the estimate of the response of path S(z), by a filter 51 that has a response $SE_{COPY}(z)$, the output of which is decimated by a factor of 32 by a decimator 52A to yield a baseband audio signal that is provided, through an infinite impulse response (IIR) filter 53A to leaky LMS 54A. The error microphone signal err is generated by a delta-sigma ADC 41C that operates at 64 times oversampling and the output of which is decimated by a factor of two by a decimator 42B to yield a 32 times oversampled signal. As in the system of FIG. 3, an amount of downlink audio ds that has been filtered by an adaptive filter to apply an estimated response of path S(z) is removed from error microphone signal err by a combiner 46C, the output of which is decimated by a factor of 32 by a decimator 52C to yield a baseband audio signal that is provided, through an infinite impulse response (IIR) filter 53B to leaky LMS 54A. Response S(z) is produced by another parallel set of adaptive filter stages 55A and 55B, one of which, filter stage 55B has fixed response $SE_{FIXED}(z)$, and the other of which, filter stage 55A has an adaptive response $SE_{ADAPT}(z)$ controlled by leaky LMS coefficient controller 54B. The outputs of adaptive filter stages 55A and 55B are combined by a combiner 46E. Similar to the implementation of transfer function W(z) described above, filter response $SE_{FIXED}(z)$ is generally a predetermined response known to provide a suitable starting point under various operating conditions for electrical/acoustical path S(z). A separate control value is provided in the system of FIG. 5 to control adaptive filter 51 that has a response $SE_{COPY}(z)$, and which is shown as a single adaptive filter stage. However, adaptive filter 51 could alternatively be implemented using two parallel stages, and the same control value used to control adaptive filter stage 55A could then be used to control the adaptive stage in the implementation of adaptive filter 51. The inputs to leaky LMS control block 54B are also at baseband, provided by decimating downlink audio signal ds by a decimator 52B that decimates by a factor of 32 after a combiner 46C has removed the signal generated from the combined outputs of adaptive filter stage 55A and filter stage 55B that are combined by another combiner 46E. The output of combiner 46C represents error microphone signal err with the components due to downlink audio signal ds removed, which is provided to LMS control block 54B after decimation by decimator 52B. The other input to LMS control block 54B is the baseband signal produced by decimator 52C.

The above arrangement of baseband and oversampled signaling provides for simplified control and reduced power consumed in the adaptive control blocks, such as leaky LMS controllers 54A and 54B, while providing the tap flexibility afforded by implementing adaptive filter stages 44A-44B, 55A-55B and adaptive filter 51 at the oversampled rates. The remainder of the system of FIG. 5 includes a combiner 46D that combines downlink audio ds with internal audio ia and a portion of near-end speech that has been generated by sigma-delta ADC 41B and filtered by a sidetone attenuator 56 to prevent feedback conditions. The output of combiner 46D is shaped by a sigma-delta shaper 43B that provides inputs to filter stages 55A and 55B that has been shaped to shift images outside of bands where filter stages 55A and 55B will have significant response.

In accordance with an embodiment of the invention, the output of combiner 46D is also combined with the output of adaptive filter stages 44A-44B that have been processed by a control chain that includes a corresponding hard mute block 45A, 45B for each of the filter stages, a combiner 46A that combines the outputs of hard mute blocks 45A, 45B, a soft mute 47 that ramps up the gain or ramps down the gain of the anti-noise channel when commencing or ending ANC operation, and then a soft limiter 48 to produce the anti-noise signal. The anti-noise signal is then subtracted by a combiner 46B from the source audio output of combiner 46D. In the present embodiment, soft limiter 48 includes speaker damage prevention circuits as described above with reference to FIG. 3 and FIG. 4. The output of combiner 46B is interpolated up by a factor of two by an interpolator 49 and then reproduced by a sigma-delta DAC 50 operated at the 64× oversampling rate. The output of DAC 50 is provided to amplifier A1, which generates the signal delivered to speaker SPKR.

Event detection and control block 38 receives various inputs for event detection, such as the output of decimator 52C, which represents how well the ANC system is canceling acoustic noise as measured at error microphone E, the output of decimator 52A, which represents the ambient acoustic environment shaped by path SE(z), downlink audio signal ds, and near-end speech signal ns. Depending on detected acoustic events, or other environmental factors such as the position of wireless telephone 10 relative to ear 5, event detection and control block 38 will generate various outputs, which are not shown in FIG. 5 for clarity, but that may control, among other elements, whether hard mute blocks 45A-45B are applied, characteristics of mute 47 and limiter 48, whether leaky LMS control blocks 54A and 54B are frozen or reset, and in some embodiments of the invention, what fixed responses are selected for the fixed portion of the adaptive filters, e.g., adaptive filter stages 44B and 55B.

Each or some of the elements in the system of FIG. 5, as well in as the exemplary circuits of FIGS. 2-4, can be implemented directly in logic, or by a processor such as a digital signal processing (DSP) core executing program instructions that perform operations such as the adaptive filtering and LMS coefficient computations. While the DAC and ADC stages are generally implemented with dedicated mixed-signal circuits, the architecture of the ANC system of the present invention will generally lend itself to a hybrid approach in which logic may be, for example, used in the highly oversampled sections of the design, while program code or microcode-driven processing elements are chosen for the more complex, but lower rate operations such as computing the taps for the adaptive filters and/or responding to detected events such as those described herein.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A personal audio device, comprising:

a personal audio device housing;

a transducer mounted on the housing for reproducing an audio signal including both source audio for playback to a listener and an anti-noise signal for countering the effects of ambient audio sounds in an acoustic output of the transducer;

a reference microphone mounted on the housing for providing a reference microphone signal indicative of the ambient audio sounds;

an error microphone mounted on the housing that provides an error microphone signal indicative of the acoustic output of the transducer; and a processing circuit within the housing for adaptively generating the anti-noise signal from the reference microphone signal such that the anti-noise signal causes substantial cancellation of the ambient audio sounds, and wherein the processing circuit further monitors a level of the anti-noise signal, determines that the anti-noise signal may cause damage to the transducer and adjusts the generation of the anti-noise signal such that damage to the transducer is prevented, and wherein the processing circuit implements an adaptive filter having a response that shapes the anti-noise signal to reduce the presence of the ambient audio sounds in the error microphone signal, and wherein the processing circuit, in response to determining that the anti-noise signal may cause damage to the transducer, freezes adaptation of the adaptive filter.

2. The personal audio device of claim 1, wherein the processing circuit limits or compresses the anti-noise signal in response to determining that the anti-noise signal has exceeded a first threshold.

3. The personal audio device of claim 2, wherein the processing circuit first limits or first compresses the anti-noise signal in response to determining that the anti-noise signal has low frequency components that have exceeded the first threshold.

4. The personal audio device of claim 3, wherein the processing circuit second limits or second compresses a result of the first limiting or first compressing by determining that the full bandwidth of the result of the first limiting or first compressing signal has exceeded a second threshold.

5. The personal audio device of claim 1, wherein the processing circuit first limits or first compresses the anti-noise signal in response to determining that the anti-noise signal has low frequency components that have exceeded a first threshold and second limits or second compresses a result of the first limiting or first compressing by determining that the full bandwidth of the result of the first limiting or first compressing signal has exceeded a second threshold, and wherein the processing circuit freezes adaptation of the adaptive filter if the low frequency components of the anti-noise signal have exceeded the first threshold.

6. The personal audio device of claim 5, wherein the processing circuit also freezes adaptation of the adaptive filter if the full bandwidth of the result of the first limiting or first compressing signal has exceeded the second threshold.

7. The personal audio device of claim 1, wherein the processing circuit first limits or first compresses the anti-noise signal in response to determining that the anti-noise signal has low frequency components that have exceeded a first threshold and second limits or second compresses a result of the first limiting or first compressing by determining that the full bandwidth of the result of the first limiting or first compressing signal has exceeded a second threshold, and wherein the processing circuit freezes adaptation of the adaptive filter if either of the first threshold or second threshold have been exceeded.

8. The personal audio device of claim 1, wherein the personal audio device is a wireless telephone further comprising a transceiver for receiving the source audio as a downlink audio signal.

9. The personal audio device of claim 1, wherein the personal audio device is an audio playback device, wherein the source audio is a program audio signal.

10. A method of preventing damage to a transducer of a personal audio device having adaptive noise canceling, the method comprising:

measuring ambient audio sounds with a reference microphone;

adaptively generating an anti-noise signal from a result of the measuring for countering the effects of ambient audio sounds in an acoustic output of the transducer;

combining the anti-noise signal with a source audio signal;

providing a result of the combining to a transducer;

measuring the acoustic output of the transducer with an error microphone, wherein the adaptively generating implements an adaptive filter having a response that shapes the anti-noise signal to reduce the presence of the ambient audio sounds in the result of the measuring the acoustic output of the transducer;

monitoring a level of the anti-noise signal;

determining that the anti-noise signal may cause damage to the transducer;

adjusting the anti-noise signal such that damage to the transducer is prevented; and in response to determining that the anti-noise signal may cause damage to the transducer, freezing adaptation of the adaptive filter.

11. The method of claim 10, wherein the adjusting comprises limiting or compressing the anti-noise signal in response to determining that the anti-noise signal has exceeded a first threshold.

12. The method of claim 11, wherein limiting or compressing comprises first limiting or first compressing the anti-noise signal in response to determining that the anti-noise signal has low frequency components that have exceeded the first threshold.

13. The method of claim 12, further comprising second limiting or second compressing a result of the first limiting or first compressing by determining that the full bandwidth of the result of the first limiting or first compressing signal has exceeded a second threshold.

14. The method of claim 10, further comprising:

first limiting or first compressing the anti-noise signal in response to determining that the anti-noise signal has low frequency components that have exceeded the first threshold; and second limiting or second compressing a result of the first limiting or first compressing by determining that the full bandwidth of the result of the first limiting or first compressing signal has exceeded a second threshold, and wherein the freezing is performed in response to determining that the low frequency components of the anti-noise signal have exceeded the first threshold.

15. The method of claim 14, wherein the freezing is also performed in response to determining that the full bandwidth of the result of the first limiting or first compressing signal has exceeded the second threshold.

16. The method of claim 10, further comprising:

first limiting or first compressing the anti-noise signal in response to determining that the anti-noise signal has low frequency components that have exceeded the first threshold; and second limiting or second compressing a result of the first limiting or first compressing by determining that the full bandwidth of the result of the first limiting or first compressing signal has exceeded a second threshold, and wherein the freezing is performed in response to determining that the low frequency components of the anti-noise signal have exceeded the first threshold, and wherein the freezing is performed in response to determining that either of the first threshold or the second threshold have been exceeded.

17. The method of claim 10, wherein the personal audio device is a wireless telephone, and wherein the method further comprises receiving the source audio as a downlink audio signal.

18. The method of claim 10, wherein the personal audio device is an audio playback device, wherein the source audio is a program audio signal.

19. An integrated circuit for implementing at least a portion of a personal audio device, comprising:

an output for providing a signal to a transducer including both source audio for playback to a listener and an anti-noise signal for countering the effects of ambient audio sounds in an acoustic output of the transducer;

a reference microphone input for receiving a reference microphone signal indicative of the ambient audio sounds;

an error microphone input for receiving an error microphone signal indicative of the acoustic output of the transducer; and a processing circuit for adaptively generating the anti-noise signal from the reference microphone signal such that the anti-noise signal causes substantial cancellation of the ambient audio sounds, and wherein the processing circuit further monitors a level of the anti-noise signal, determines that the anti-noise signal may cause damage to the transducer and adjusts the generation of the anti-noise signal such that damage to the transducer is prevented, wherein the processing circuit implements an adaptive filter having a response that shapes the anti-noise signal to reduce the presence of the ambient audio sounds in the error microphone signal, and wherein the processing circuit, in response to determining that the anti-noise signal may cause damage to the transducer, freezes adaptation of the adaptive filter.

20. The integrated circuit of claim 19, wherein the processing circuit limits or compresses the anti-noise signal in response to determining that the anti-noise signal has exceeded a first threshold.

21. The integrated circuit of claim 20, wherein the processing circuit first limits or first compresses the anti-noise signal in response to determining that the anti-noise signal has low frequency components that have exceeded the first threshold.

22. The integrated circuit of claim 21, wherein the processing circuit second limits or second compresses a result of the first limiting or first compressing by determining that the full bandwidth of the result of the first limiting or first compressing signal has exceeded a second threshold.

23. The integrated circuit of claim 19, wherein the processing circuit first limits or first compresses the anti-noise signal in response to determining that the anti-noise signal has low frequency components that have exceeded a first threshold and second limits or second compresses a result of the first limiting or first compressing by determining that the full bandwidth of the result of the first limiting or first compressing signal has exceeded a second threshold, and wherein the processing circuit freezes adaptation of the adaptive filter if the low frequency components of the anti-noise signal have exceeded the first threshold.

24. The integrated circuit of claim 23, wherein the processing circuit also freezes adaptation of the adaptive filter if the full bandwidth of the result of the first limiting or first compressing signal has exceeded the second threshold.

25. The integrated circuit of claim 19, wherein the processing circuit first limits or first compresses the anti-noise signal in response to determining that the anti-noise signal has low frequency components that have exceeded a first threshold and second limits or second compresses a result of the first limiting or first compressing by determining that the full bandwidth of the result of the first limiting or first compressing signal has exceeded a second threshold, and wherein the processing circuit freezes adaptation of the adaptive filter if either of the first threshold or the second threshold have been exceeded.

* * * * *